US011484890B2

(12) United States Patent
Tomimatsu et al.

(10) Patent No.: US 11,484,890 B2
(45) Date of Patent: Nov. 1, 2022

(54) ELECTROSTATIC PRECIPITATOR

(71) Applicant: MITSUBISHI HITACHI POWER SYSTEMS ENVIRONMENTAL SOLUTIONS, LTD., Yokohama (JP)

(72) Inventors: Kazutaka Tomimatsu, Kanagawa (JP); Masaya Kato, Kanagawa (JP); Yasutoshi Ueda, Tokyo (JP)

(73) Assignee: MITSUBISHI HEAVY INDUSTRIES POWER ENVIRONMENTAL SOLUTIONS, LTD., Yokohama (JP)

( * ) Notice: Subject to any disclaimer, the term of this patent is extended or adjusted under 35 U.S.C. 154(b) by 203 days.

(21) Appl. No.: 16/961,772

(22) PCT Filed: Dec. 28, 2018

(86) PCT No.: PCT/JP2018/048401
§ 371 (c)(1),
(2) Date: Jul. 13, 2020

(87) PCT Pub. No.: WO2019/138922
PCT Pub. Date: Jul. 18, 2019

(65) Prior Publication Data

US 2021/0060578 A1 Mar. 4, 2021

(30) Foreign Application Priority Data

Jan. 15, 2018 (JP) ..... JP2018-004364

(51) Int. Cl.
*B03C 3/49* (2006.01)
*B03C 3/41* (2006.01)

(52) U.S. Cl.
CPC . *B03C 3/49* (2013.01); *B03C 3/41* (2013.01)

(58) Field of Classification Search
CPC combination set(s) only.
See application file for complete search history.

(56) References Cited

U.S. PATENT DOCUMENTS 1,773,835 A 8/1930 Wintermute et al.
3,958,962 A * 5/1976 Hayashi ..... B03C 3/41 96/97

(Continued)

FOREIGN PATENT DOCUMENTS

CH 215135 A 6/1941
CN 204583481 U 8/2015

(Continued)

OTHER PUBLICATIONS

Extended (Supplementary) European Search Report dated Dec. 22, 2020, issued in counterpart EP Application No. 18899145.9. (15 pages).

(Continued)

*Primary Examiner* — Christopher P Jones
*Assistant Examiner* — Sonji Turner
(74) *Attorney, Agent, or Firm* — WHDA, LLP

(57) ABSTRACT

An electrostatic precipitator is provided capable of preventing a reduction in dust collection effect of ionic wind, and increasing dust collection efficiency. The electrostatic precipitator includes: a plurality of collecting electrodes (4) in the form of circular pipes arranged at predetermined intervals in a direction orthogonal to a longitudinal direction of the electrodes; and a plurality of protrusions (5*a*) protruding toward the collecting electrodes (4) and arranged offset in parallel with the orthogonal direction. An equivalent diameter of a cross section of the collecting electrode (4) is 30 mm to 80 mm. An opening ratio of the collecting electrodes (4) arranged at predetermined intervals is 10% to 70%.

2 Claims, 9 Drawing Sheets

(56) References Cited

U.S. PATENT DOCUMENTS

| | | | | | |
|---|---|---|---|---|---|
| 4,056,372 | A * | 11/1977 | Hayashi | B03C 3/41 96/87 |
| 4,092,134 | A * | 5/1978 | Kikuchi | B03C 3/74 96/51 |
| 4,126,434 | A * | 11/1978 | Keiichi | B03C 3/40 96/76 |
| 4,342,571 | A * | 8/1982 | Hayashi | B03C 3/41 96/76 |
| 5,248,324 | A | 9/1993 | Hara | |
| 5,603,752 | A * | 2/1997 | Hara | B03C 3/08 96/93 |
| 2006/0236859 | A1 | 10/2006 | Krichtafovitch | |
| 2006/0278082 | A1 | 12/2006 | Tomimatsu et al. | |
| 2007/0247077 | A1 | 10/2007 | Krichtafovitch | |
| 2015/0360235 | A1 | 12/2015 | Ueda et al. | |
| 2015/0375237 | A1 | 12/2015 | Kojima et al. | |
| 2021/0283621 | A1 * | 9/2021 | Tomimatsu | B03C 3/10 |

FOREIGN PATENT DOCUMENTS

| | | | | |
|---|---|---|---|---|
| CN | 104955579 | A | 9/2015 | |
| CN | 104994960 | A | 10/2015 | |
| DE | 2601358 | A * | 3/1977 | B03C 3/40 |
| DE | 102011012011 | A1 | 8/2012 | |
| EA | 0161205 | A2 | 11/1985 | |
| EA | 0161205 | A3 | 3/1986 | |
| EP | 0525283 | A1 | 2/1993 | |
| EP | 2 881 177 | A1 | 6/2015 | |
| EP | 2878377 | A1 | 6/2015 | |
| JP | 42-21440 | B1 | 10/1967 | |
| JP | 61-164660 | A | 7/1986 | |
| JP | 62-7456 | A | 1/1987 | |
| JP | 2001-38243 | A | 2/2001 | |
| JP | 2011-161329 | A | 8/2011 | |
| JP | 4823691 | B2 | 11/2011 | |
| JP | 5705461 | B2 | 4/2015 | |
| JP | 5761461 | B2 | 8/2015 | |
| JP | 2016-73954 | A | 5/2016 | |
| JP | 2017-217572 | A | 12/2017 | |
| JP | 2018-126712 | A | 8/2018 | |
| JP | 2018-126713 | A | 8/2018 | |
| WO | 2014/006736 | A1 | 1/2014 | |
| WO | WO-2014006736 | A1 * | 1/2014 | B03C 3/06 |
| WO | 2016/136270 | A1 | 9/2016 | |

OTHER PUBLICATIONS

International Search Report dated Feb. 19, 2019, issued in counterpart International Application No. PCT/JP2018/048401, with English Translation. (5 pages).

Written Opinion of the International Searching Authority (Form PCT/ISA/237) dated Feb. 19, 2019, issued in counterpart International Application No. PCT/JP2018/048401 (4 pages).

Office Action dated Dec. 25, 2019, issued in counterpart TW Patent Application No. 108100290 (3 pages).

Office Action dated Dec. 29, 2021, issued in counterpart CN Application No. 201880086536.6, with English translation. (14 pages).

* cited by examiner

ELECTROSTATIC PRECIPITATOR

TECHNICAL FIELD

The present disclosure relates to an electrostatic precipitator.

BACKGROUND ART

A known conventional electrostatic precipitator includes flat collecting electrodes arranged in parallel along a gas flow, and pointed discharge electrodes arranged between the collecting electrodes.

The electrostatic precipitator applies a high DC voltage between the collecting electrodes and the discharge electrodes, and performs stable corona discharge of the discharge electrodes to electrically charge dust in the gas flow. A conventional dust collection theory describes that electrically charged dust is collected by collecting electrodes by the action of a Coulomb force applied to the dust in an electric field between the discharge electrodes and the collecting electrodes.

Electrostatic precipitators in PTL 1 and PTL 2 include a collecting electrode having a plurality of through holes through which dust passes and a closed space for collecting the dust therein. In PTL 1 and PTL 2, the dust is passed through the through holes and trapped in the closed space to prevent the collected dust from scattering again.

An electrostatic precipitator in PTL 3 includes a collecting electrode that includes a ground electrode having an opening ratio of 65% to 85%, and a dust collecting filter layer that collects dust. In PTL 3, such a collecting electrode is provided to generate ionic wind in a section orthogonal to a gas flow, and to generate a spiral gas flow circulating between a discharge electrode and the collecting electrode, thereby efficiently collecting dust. In PTL 3, the ionic wind is positively used, but the dust is mainly collected by the dust collecting filter layer.

CITATION LIST

Patent Literature

[PTL 1] The Publication of Japanese Patent No. 5761461
[PTL 2] The Publication of Japanese Patent No. 5705461
[PTL 3] The Publication of Japanese Patent No. 4823691

SUMMARY OF INVENTION

Technical Problem

Dust collection efficiency of an electrostatic precipitator can be calculated by the well-known Deutsch's equation (Expression (1)) below:

$$\eta=1-\exp(-w\times f) \quad (1)$$

where w is an index of dust collection performance (particulate migration velocity) and f is a specific collecting area (collecting area per actual gas volume).

In Expression (1) above, the particulate migration velocity w of dust (particulate matter) is determined by a relationship between the action of a Coulomb force and viscosity resistance of gas. The Deutsch's equation (Expression (1) above) assumes that dust travels in an electric field from a discharge electrode, and does not directly consider an influence of ionic wind on performance. However, there is an assumption that a dust concentration as a basis of the performance design is always uniform in a dust collection space between the discharge electrode and the collecting electrode, and the ionic wind is considered to cause disturbance of gas to provide a uniform dust concentration.

When a negative voltage is applied between the electrodes, corona discharge of the discharge electrode generates negative ions, thereby generating the ionic wind. When a positive voltage is applied, positive ions generate the ionic wind. For considering an industrial electrostatic precipitator, an example of a negative voltage being applied is described below, but the same applies to a positive voltage.

The ionic wind generated from the discharge electrode flows toward the collecting electrode to cross the gas flow. The ionic wind having reached the collecting electrode is reversed at the collecting electrode and changes its flow direction. This causes spiral turbulence between the electrodes.

In the turbulence, a flow from the discharge electrode toward the collecting electrode carries dust close to the collecting electrode. The dust carried close to the collecting electrode is finally collected by a Coulomb force.

However, the ionic wind reversed at the collecting electrode moves the dust away from the collecting electrode as a collector, and may prevent dust collection.

PTL 3 describes the electrostatic precipitator considering the effect of ionic wind. However, this collector has a complex structure in which the ionic wind is fed to a filter layer behind the collecting electrode having an opening, and is intended to collect dust in a region without any influence of main gas. Also, for a dry type electrode, it is difficult to dislodge and collect dust adhering to the filter layer.

The present disclosure is achieved in view of such circumstances and has an object to provide an electrostatic precipitator capable of preventing a separation action of ionic wind that reduces a dust collection effect, and increasing dust collection efficiency.

Solution to Problem

An aspect of the present disclosure provides an electrostatic precipitator including: a plurality of collecting electrodes having a cylindrical shape and arranged at predetermined intervals in a direction orthogonal to a longitudinal direction of the electrodes; and a plurality of discharge portions protruding toward the collecting electrodes and arranged in parallel with the orthogonal direction, wherein an equivalent diameter of a cross section of the collecting electrodes is 30 mm to 80 mm.

The cylindrical collecting electrodes are arranged at predetermined intervals to allow part of ionic wind flowing from the discharge portions toward the collecting electrodes to escape behind the collecting electrodes. This can prevent the ionic wind from being reversed at and moving away from the collecting electrodes.

The equivalent diameter of the cross section of the collecting electrode is 30 mm or more. A smaller equivalent diameter increases electric field concentration to increase dust collection performance. However, too small an equivalent diameter increases a peak value of electric field strength with a current required for dust collection being ensured, thereby causing spark discharge. Thus, a lower limit of the equivalent diameter is 30 mm.

The equivalent diameter of the cross section of the collecting electrode is 80 mm or less. A larger equivalent diameter causes little rise in electric field strength near the collecting electrode, and only average electric field strength of a flat electrode is reached. A larger equivalent diameter also generates a swirl of a gas flow. Thus, an upper limit of the equivalent diameter is 80 mm.

The equivalent diameter refers to a diameter of a circle equivalent to a cross section of a predetermined shape. Thus, for a circular cross section, the equivalent diameter corresponds to a diameter thereof.

The collecting electrode may be, for example, a pipe-like member having a circular section. However, the cross section may have, other than the circular shape, an oval shape, an elliptical shape, a polygonal shape, or the like. The collecting electrode may be hollow or solid.

A direction of gas flowing in the electrostatic precipitator may be the orthogonal direction in which the collecting electrodes are arranged or the longitudinal direction of the collecting electrodes.

The collecting electrode may dislodge and collect dust by rapping, may be moved to scrape off dust with a brush, or may perform wet cleaning.

Further, in the electrostatic precipitator according to an aspect of the present disclosure, an opening ratio of the collecting electrodes arranged at predetermined intervals is 10% to 70%.

An opening ratio of less than 10% reduces an effect of preventing moving away of the ionic wind. An opening ratio higher than 70% reduces an effective dust collection area and reduces dust collection performance.

An opening ratio $\alpha$ is expresses as described below:

$$\alpha=\{1-((d\times 3.14/2)/Pc)\}\times 100$$

where d is an equivalent diameter and Pc is a center-to-center pitch between the collecting electrodes.

Further, in the electrostatic precipitator according to an aspect of the present disclosure, one and the other discharge portions are arranged on opposite sides of the collecting electrodes arranged in the orthogonal direction, the one and the other of the discharge portions being arranged such that ionic wind flowing from the one discharge portion toward the collecting electrodes does not oppose ionic wind flowing from the other discharge portion toward the collecting electrodes.

The one and the other of the discharge portions are arranged on opposite sides of the collecting electrodes arranged in the orthogonal direction such that ionic wind flowing from the one discharge portion toward the collecting electrodes do not oppose ionic wind flowing from the other discharge portion toward the collecting electrodes. This can prevent interference of ionic wind to hinder dust collection.

Advantageous Effects of Invention

The cylindrical collecting electrodes arranged at predetermined intervals are used to prevent ionic wind from moving away from the collecting electrodes and increase dust collection efficiency.

DESCRIPTION OF EMBODIMENTS

Now, an embodiment of an electrostatic precipitator according to the present disclosure will be described with reference to the drawings.

An electrostatic precipitator 1 is used, for example, in a thermal power generation plant using coal or the like as fuel, and collects dust (particulate matter) in a combustion exhaust gas guided from a boiler.

Figure 1:
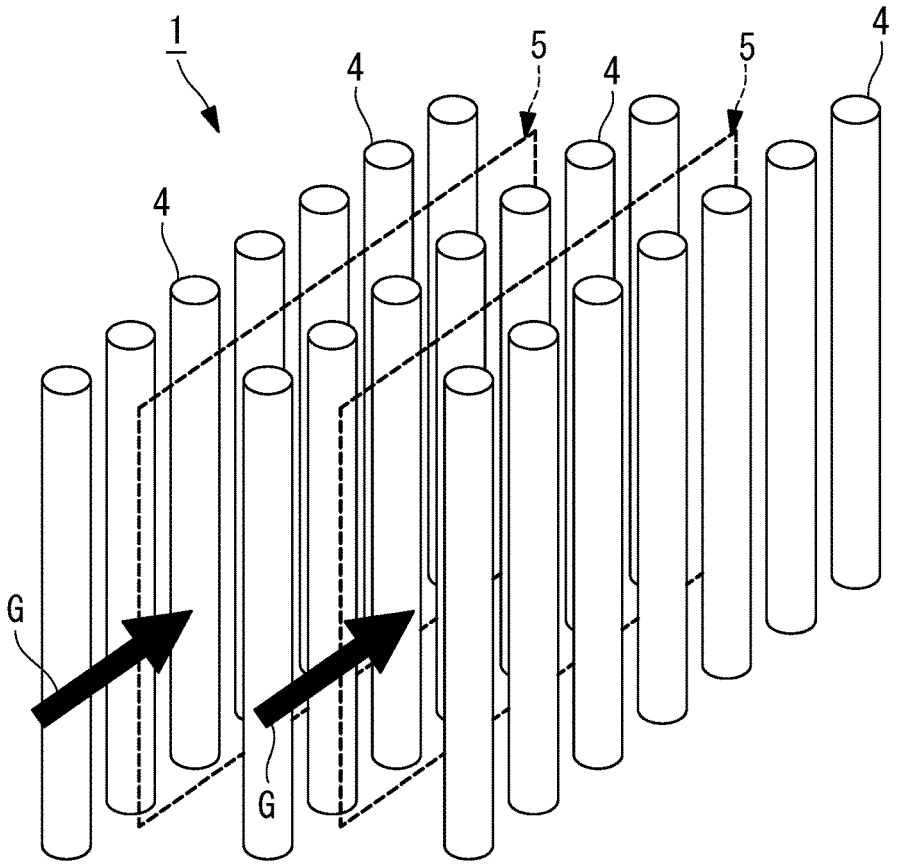
FIG. 1 is a perspective view of an electrostatic precipitator according to an embodiment of the present disclosure.

The electrostatic precipitator 1 includes a plurality of conductive collecting electrodes 4 made of, for example, metal. The collecting electrodes 4 are hollow cylindrical circular pipes having a circular cross section, and arranged at predetermined intervals in an orthogonal direction (direction of a gas flow G) orthogonal to a longitudinal direction. A plurality of rows of the collecting electrodes 4 arranged in the direction of the gas flow G are provided in parallel at predetermined intervals. Between the rows of the collecting electrodes 4, discharge electrodes 5 are arranged. In FIG. 1, dashed lines show positions of the discharge electrodes 5.

The collecting electrodes 4 are grounded. The discharge electrodes 5 are connected to a power supply (not shown) having a negative polarity. The power supply connected to the discharge electrodes 5 may have a positive polarity.

Figure 2:
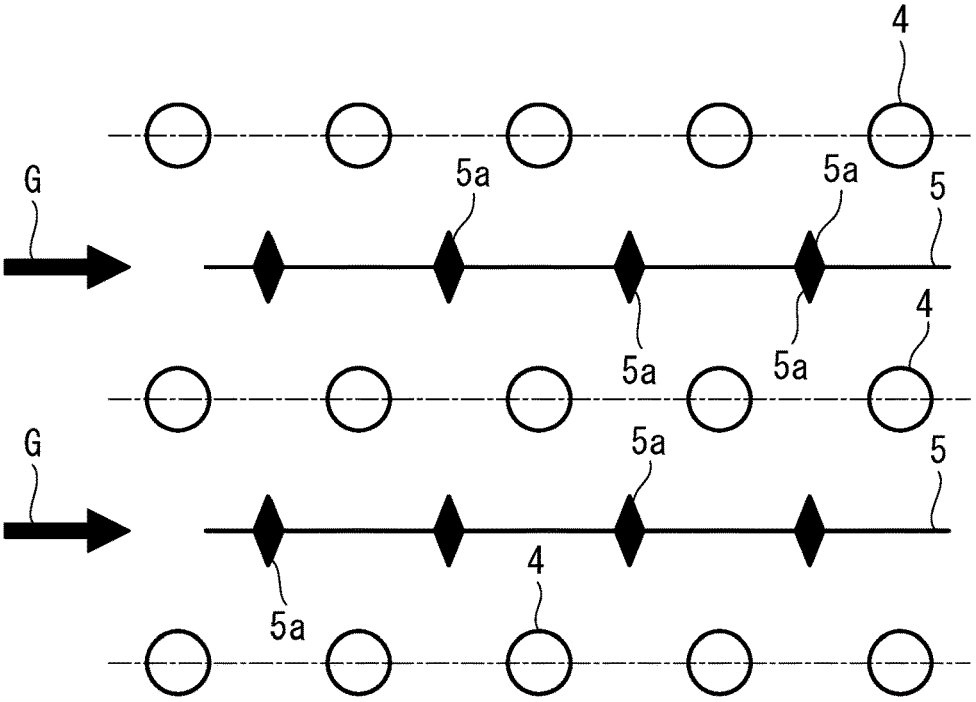
FIG. 2 is a plan view of the electrostatic precipitator in FIG. 1 seen from above.

As shown in FIG. 2, each discharge electrode 5 has a plurality of pointed protrusions (discharge portions) 5*a*. The protrusion 5*a* protrudes with a tip directed toward the collecting electrode 4. Corona discharge occurs at the protrusion 5*a*, and ionic wind is generated from the tip of the protrusion 5*a* toward the collecting electrode 4.

Figure 3:
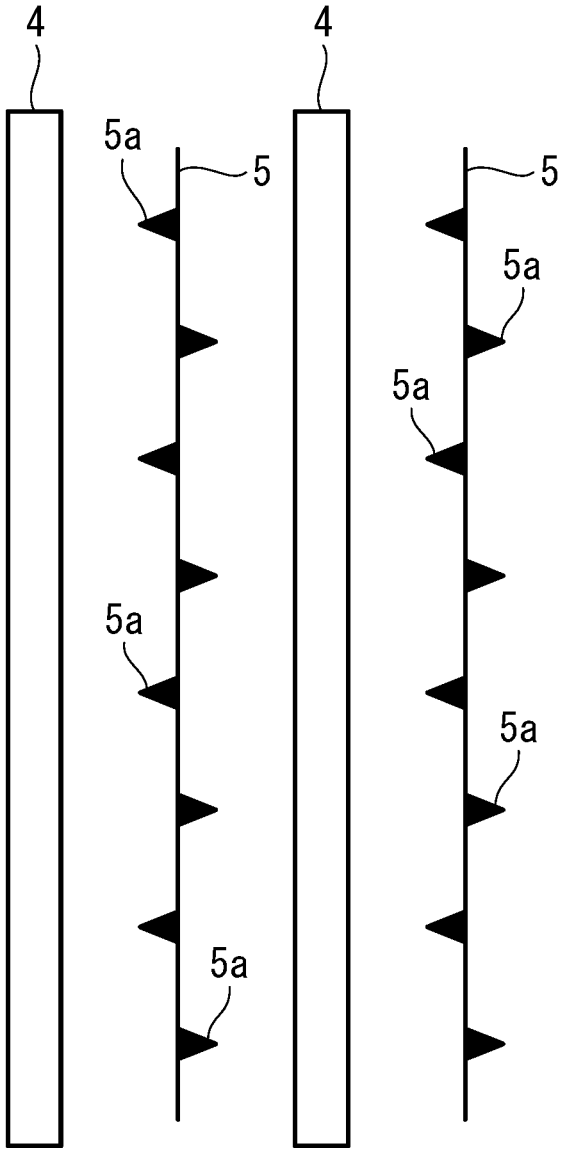
FIG. 3 is a front view of the electrostatic precipitator in FIG. 1 seen from a gas flow direction.

FIG. 3 is a front view of FIG. 1 seen from the direction of the gas flow G. As shown, the protrusions 5*a* are provided to be alternately directed in opposite directions (alternately directed to left and right in FIG. 3) in a height direction. Corresponding protrusions 5*a* at the same height protrude in the same direction with the collecting electrode 4 therebetween. The protrusions 5*a* are arranged in this manner so that the ionic wind flowing from the protrusions 5*a* toward the collecting electrodes 4 is directed substantially in the same direction in the height direction. This can prevent interference of the ionic wind.

Figure 4:
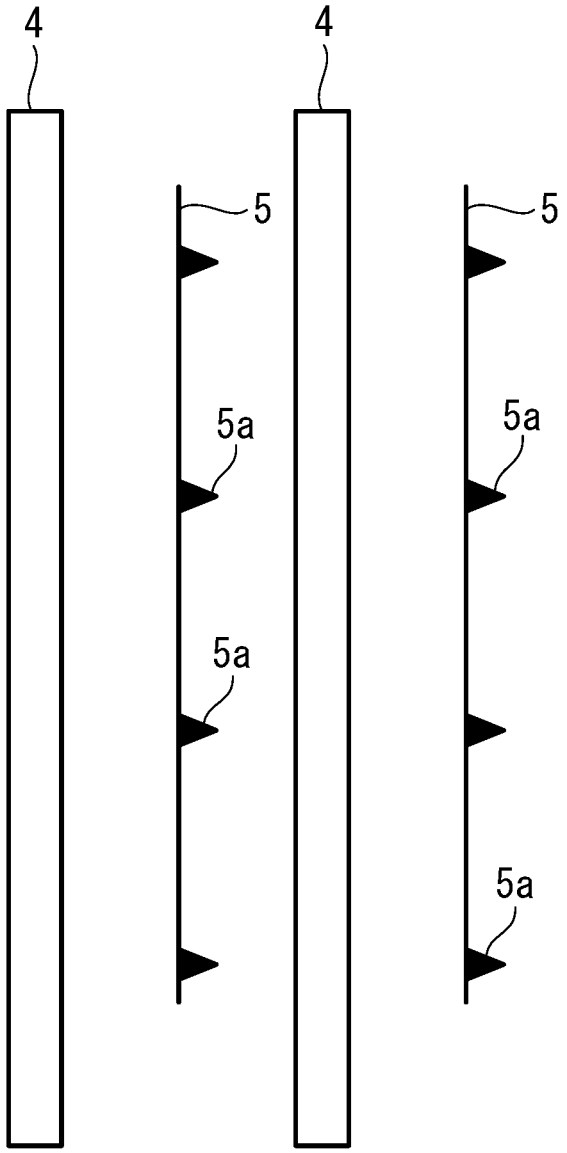
FIG. 4 is a front view of a variant of FIG. 3.

As shown in FIG. 4, all the protrusions 5*a* may be directed in the same direction (right in FIG. 4) so that the ionic wind is directed in a uniform direction.

Figure 5:
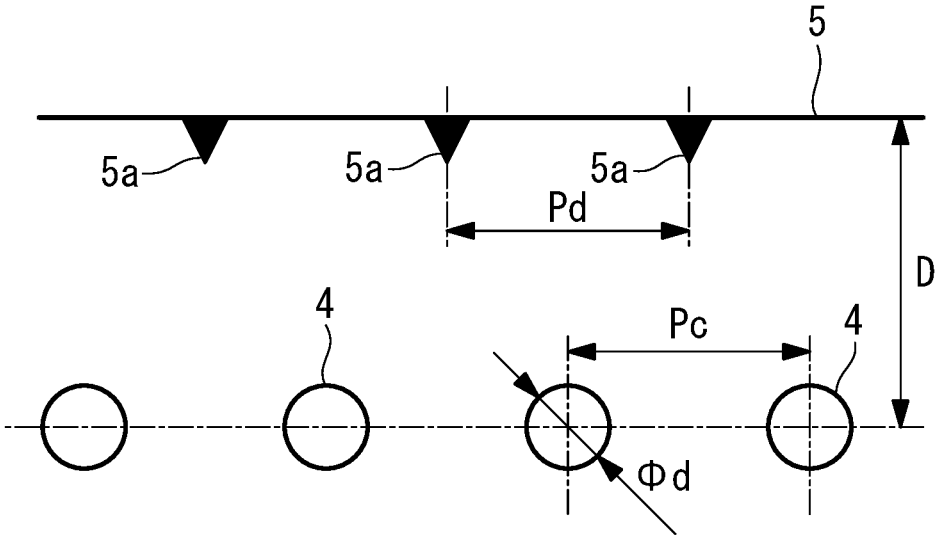
FIG. 5 is a sectional view of a positional relationship between collecting electrodes and protrusions.
Figure 6:
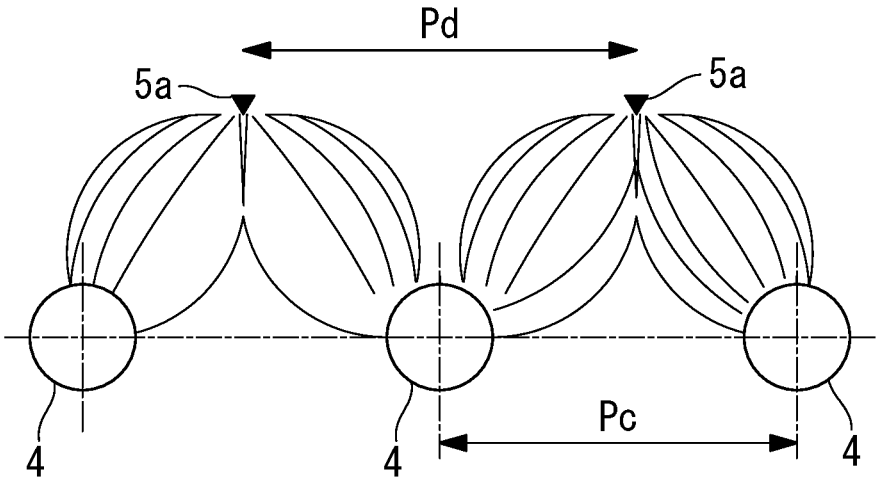
FIG. 6 is a sectional view of line of electric force between the protrusions and the collecting electrodes.

FIG. 5 shows a positional relationship between the collecting electrodes 4 and the protrusions 5*a*. FIG. 5 is a sectional view taken at a position of the protrusions 5*a* at a certain height in FIG. 2. Thus, the protrusions 5*a* do not appear on opposite sides as in FIG. 2 in plan view, but the protrusions 5*a* are shown directed to only one side. As shown in FIG. 5, a center-to-center pitch Pc between the collecting electrodes 4 and a center-to-center pitch Pd between the protrusions 5*a* are preferably equal. Also, the protrusions 5*a* are preferably arranged to face spaces between adjacent collecting electrodes 4 in a staggered manner. With such an arrangement, as shown in FIG. 6, line of electric force are equally distributed to the collecting electrodes 4, and can reach a deep side of the circular cross sections of the collecting electrodes 4 when seen from the protrusions 5*a*. Reference character D in FIG. 5 denotes a distance between the collecting electrode 4 and the protrusion 5*a* in the orthogonal direction (vertical direction in FIG. 5), which is, for example, 125 to 250 mm.

Considering that the line of electric force reach the deep side of the collecting electrodes 4 in this manner, an opening ratio α of the collecting electrodes 4 in front view from the protrusions 5*a* is expressed as below:

$$\alpha=\{1-((d\times 3.14/2)/Pc)\}\times 100$$

where d is an equivalent diameter of the collecting electrode 4. The equivalent diameter refers to a diameter of a circle equivalent to (having the same area as) a cross section of a predetermined shape. Thus, when the collecting electrode 4 has a circular cross section as in this embodiment, the equivalent diameter corresponds to a diameter thereof.

The opening ratio α is 10% to 70%. The reason therefor will be described later with reference to FIG. 11.

The equivalent diameter d of the collecting electrode 4 is 30 mm to 80 mm.

Figure 7:
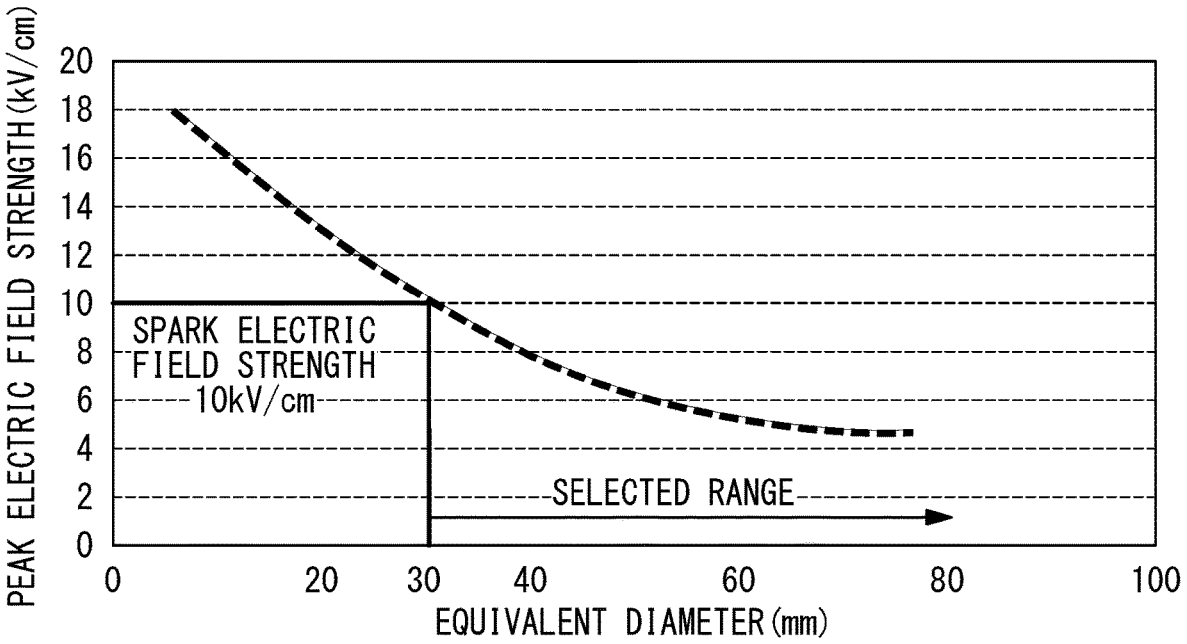
FIG. 7 is a graph showing a reason that a lower limit of an equivalent diameter of the collecting electrode is 30 mm.

The equivalent diameter d of the cross section of the collecting electrode 4 is 30 mm or more for the following reason. A smaller equivalent diameter d increases electric field concentration to increase dust collection performance. However, as shown in FIG. 7, too small an equivalent diameter d increases a peak value of electric field strength with a current density (for example, 0.3 $mA/m^2$) required for dust collection being ensured, and the peak value exceeds spark electric field strength of 10 kV/cm, thereby causing spark discharge. Thus, a lower limit of the equivalent diameter d is 30 mm.

The equivalent diameter d of the cross section of the collecting electrode 4 is 80 mm or less for the following reason. A larger equivalent diameter causes little rise in electric field strength near the collecting electrode (described later with reference to FIG. 9), and only average electric field strength (2 kV/cm) of a flat electrode without any bore is reached. A larger equivalent diameter d also has an influence on gas flow and generates a swirl. Thus, the upper limit of the equivalent diameter d is 80 mm. For example, average electric field strength at the equivalent diameter d of 30 mm calculated under the same condition as the above is about 5.7 kV/cm.

Figure 8:
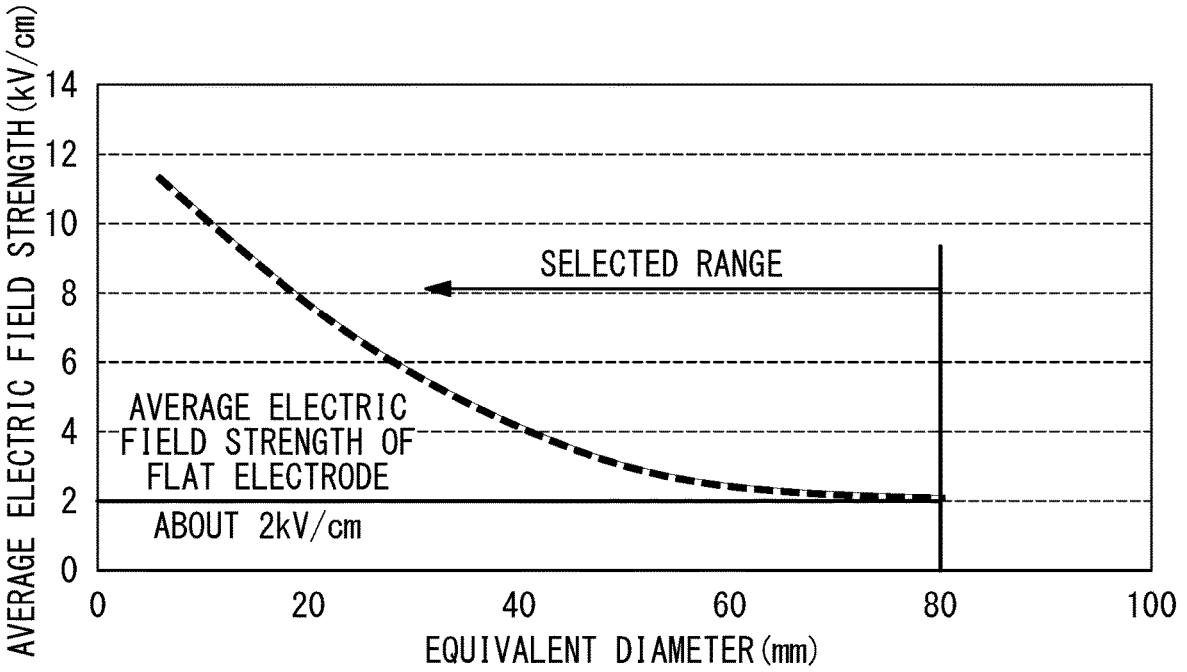
FIG. 8 is a graph showing a reason that an upper limit of the equivalent diameter of the collecting electrode is 80 mm.

The ordinate in FIG. 8 represents average electric field strength, which is electric field strength averaged by a surface area of the collecting electrode 4. The average electric field strength is different from peak electric field strength on the ordinate in FIG. 7. The peak electric field strength is electric field strength at a position with highest electric field strength on a surface of the collecting electrode 4.

Figure 9:
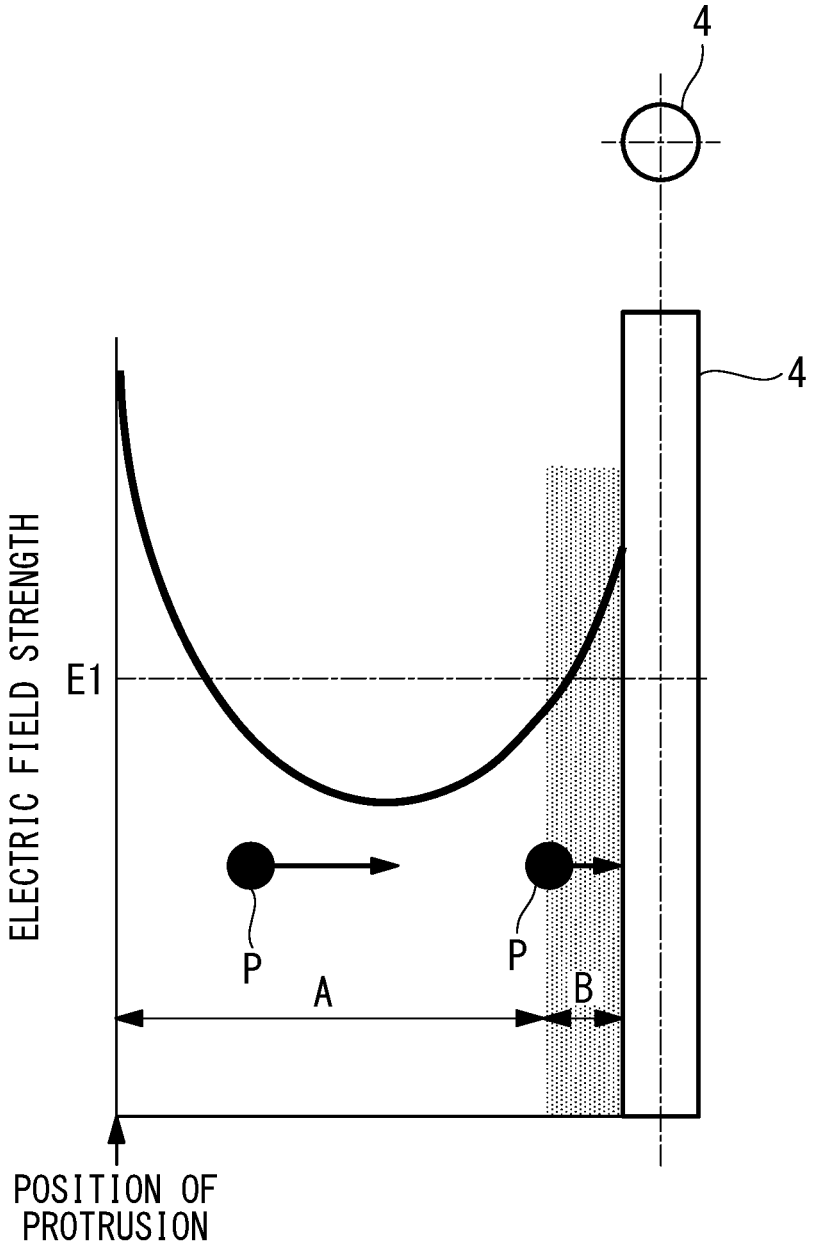
FIG. 9 is a graph showing a rise in electric field strength of the collecting electrode.

Next, with reference to FIG. 9, a rise in electric field strength near the collecting electrode 4 will be described. As shown, the abscissa represents a position, and the protrusion 5*a* is assumed to be located at a position corresponding to the y-axis. The ordinate represents electric field strength. The electric field strength is highest at the position of the protrusion 5*a*, reaches a minimum value between the protrusion 5*a* and the collecting electrode 4, and then increases again toward the collecting electrode 4. Near the collecting electrode 4, there is a region B with a high rate of increase in (gradient of) electric field strength. This is because the electric field strength is increased near the collecting electrode 4 due to space charge of dust or negative ions. The increase in electric field strength in this region B is referred to as "a rise in electric field strength". In the region B, a Coulomb force is dominant, and dust P is effectively collected by the collecting electrode 4.

In a region A closer to the protrusion 5*a* than the region B, ionic wind is dominant. In the region A, the dust P in the gas is subjected to the Coulomb force, but mainly guided on the ionic wind to the collecting electrode 4.

Figure 10:
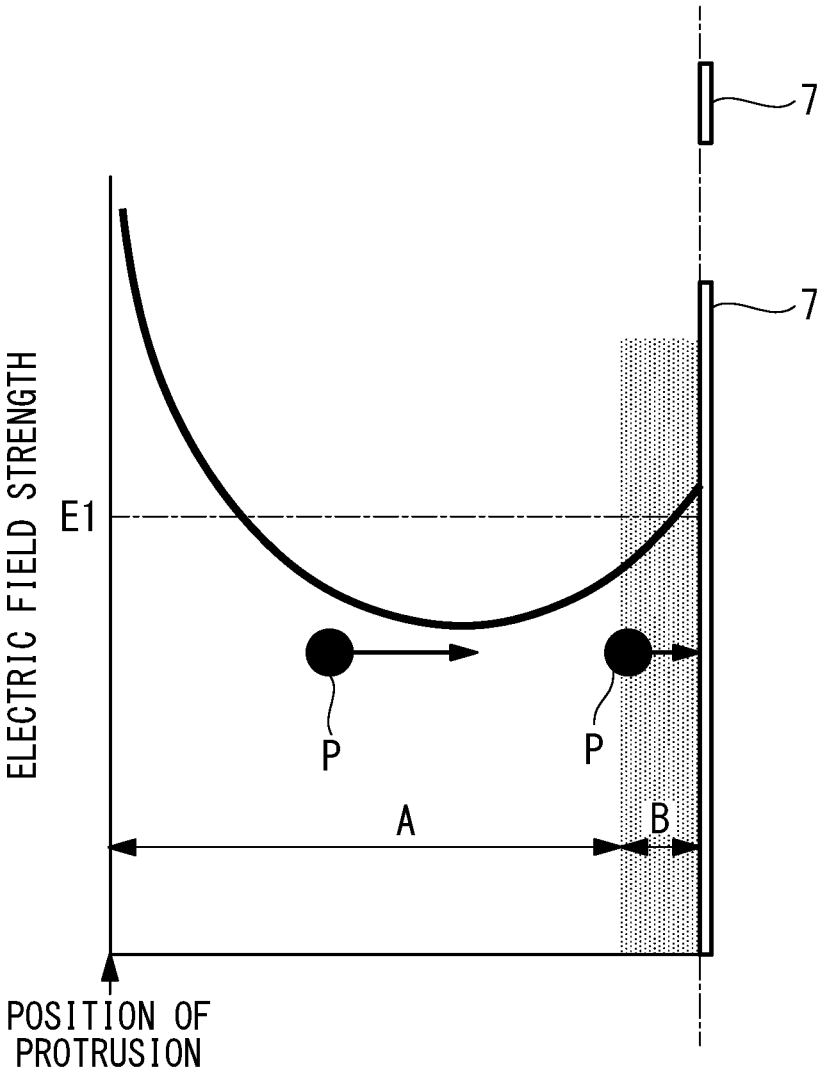
FIG. 10 is a graph showing a rise in electric field strength of a flat electrode.

FIG. 10 shows, as a reference example, electric field strength when a conventional flat electrode 7 without any bore is used as a collecting electrode. As seen from FIG. 10, an absolute value of electric field strength near the flat electrode 7 is smaller than that of the collecting electrode 4 in the form of a circular pipe in FIG. 9, also with a smaller rise in electric field strength. Thus, it is found that dust collection performance is lower than that of the collecting electrode 4 in the form of the circular pipe.

Figure 11:
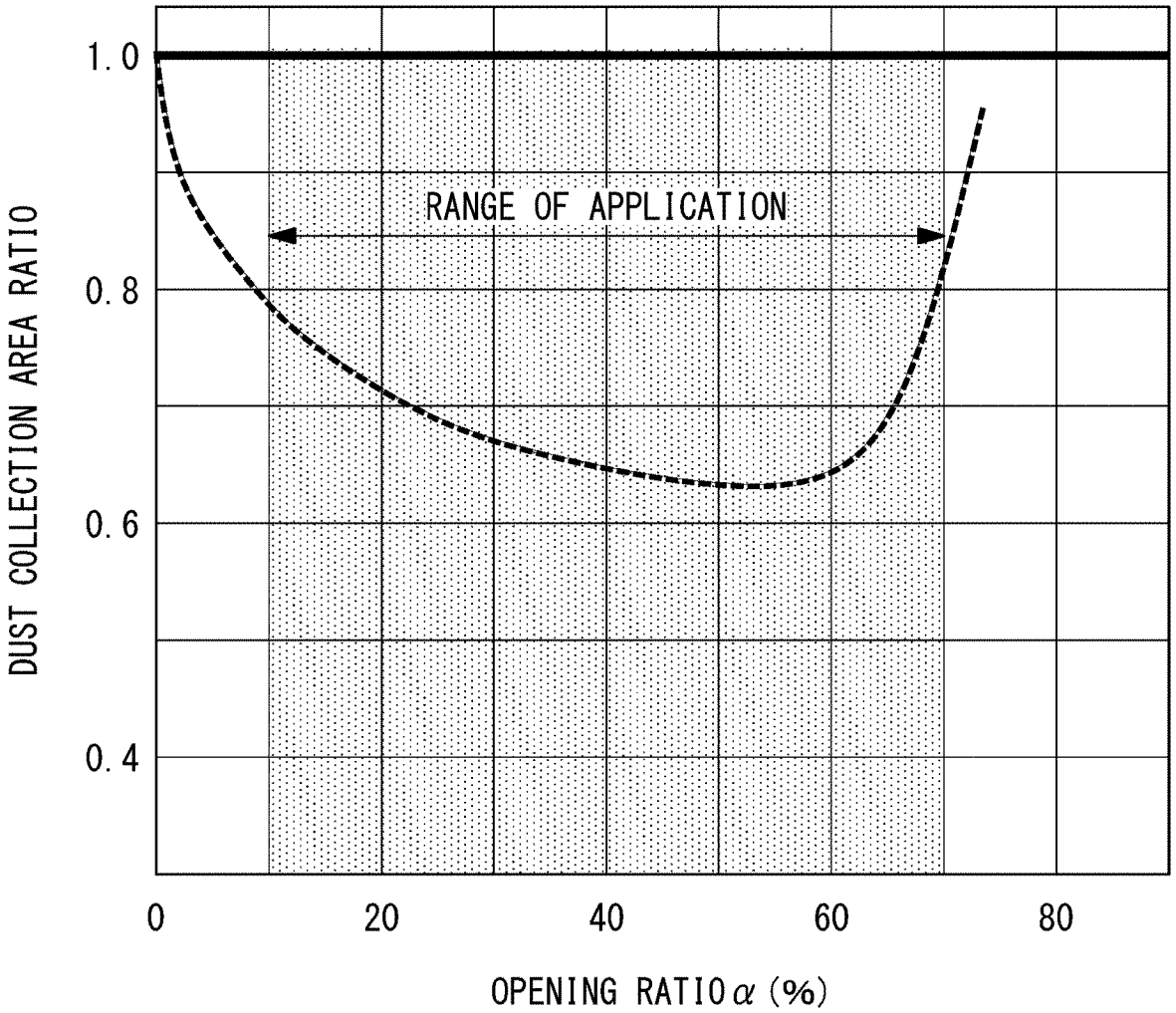
FIG. 11 is a graph showing the dust collection area ratio relative to the opening ratio.

FIG. 11 shows a dust collection area ratio relative to an opening ratio α. The dust collection area ratio refers to a dust collection area providing the same dust collection performance with dust collection performance at an opening ratio of 0% (no gap) being 1. Thus, a smaller dust collection area ratio refers to higher collection efficiency.

As shown in FIG. 11, the dust collection area ratio is 0.8 or less at the opening ratio α of 10% to 70%. Thus, the opening ratio α is preferably 10% to 70% (range of application).

Next, an operation of the electrostatic precipitator 1 of this embodiment will be described.

In the electrostatic precipitator 1, a power supply applies a negative voltage to the discharge electrode 5 to cause corona discharge at the tip of the protrusion 5*a*. Dust contained in the gas flow G is electrically charged by the corona discharge. By the collection principle of the conventional electrostatic precipitators, electrically charged dust is attracted to the grounded collecting electrode 4 by a Coulomb force, and collected on the collecting electrode 4. However, ionic wind actually has a great influence.

When corona discharge occurs, negative ions are generated near the protrusion 5*a*, and moved toward the collecting electrode 4 by an electric field to generate ionic wind. Thus, simultaneously with the Coulomb force acting on the dust, the ionic wind flowing toward the collecting electrode 4 moves the dust contained in the gas flow G close to the collecting electrode 4. Then, due to a large rise in electric field strength in the region B (see FIG. 9) near the collecting electrode 4, the dust is effectively collected. Also, the collecting electrodes 4 in the form of circular pipes are arranged at predetermined intervals to allow part of the ionic wind flowing from the protrusions 5*a* toward the collecting electrodes 4 to escape behind the collecting electrodes 4. This can prevent the ionic wind from being reversed at and moving away from the collecting electrodes 4, thereby increasing collection efficiency.

Part of the ionic wind containing dust flowing toward the collecting electrodes 4 passes between the collecting electrodes 4. As shown in FIGS. 3 and 4, all the protrusions 5*a* at the same height are directed in the same direction. Thus, the ionic wind is directed in a uniform direction and does not interfere.

The dust collected by the collecting electrode 4 is dislodged and collected by rapping. Alternatively the collecting electrode may be moved to scrape off the dust with a brush, or wet cleaning may be adopted.

This embodiment has the following effects.

The collecting electrodes 4 in the form of the circular pipes are arranged at predetermined intervals to allow part of the ionic wind flowing from the protrusions 5*a* toward the collecting electrodes 4 to escape behind the collecting electrodes 4. This can prevent the ionic wind from being reversed at and moving away from the collecting electrodes 4.

The equivalent diameter d of the cross section of the collecting electrode 4 is 30 mm to 80 mm. This can increase dust collection performance of the collecting electrode 4.

The opening ratio α is 10% to 70%. This can ensure an effective dust collection area to increase dust collection performance.

The ionic wind generated from the protrusions 5*a* provided at the same height are directed in a uniform direction so as not to interfere with the ionic wind generated from the protrusions 5*a* provided at different heights (see FIG. 3). This can prevent the ionic wind from hindering dust collection.

Figure 12:
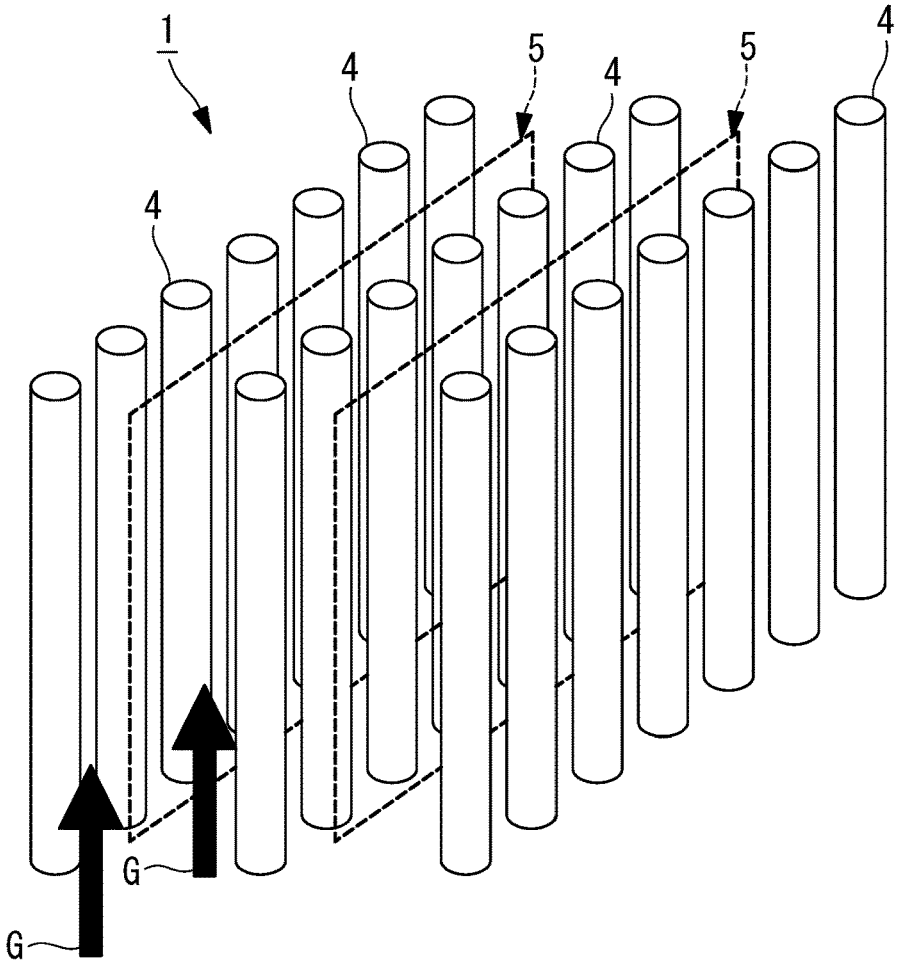
FIG. 12 is a perspective view of a variant of FIG. 1.

The above embodiment may be varied as described below. In FIG. 1, the direction of the gas flow G is orthogonal to the longitudinal direction of the collecting electrode 4. However, as shown in FIG. 12, the direction of the gas flow G may be the longitudinal direction of the collecting electrode 4.

Figure 13:
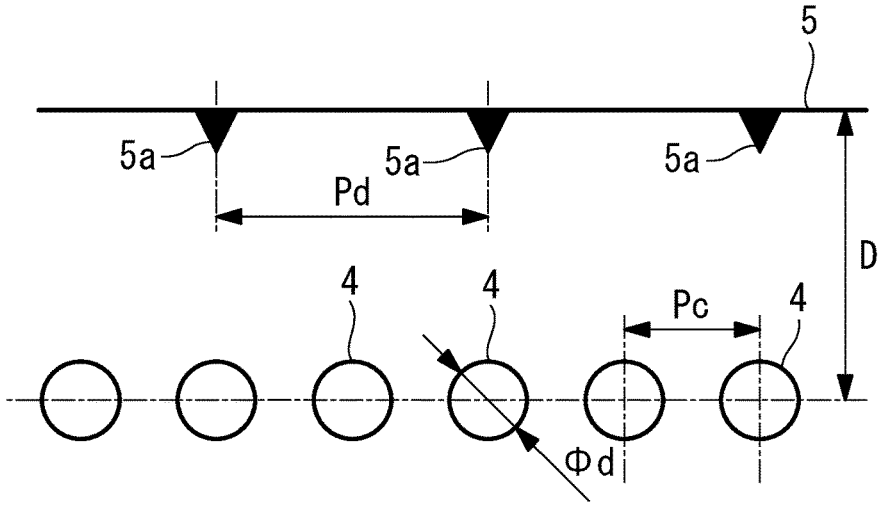
FIG. 13 is a sectional view of a variant of FIG. 5.

In FIG. 5, the pitch Pc between the collecting electrodes 4 and the pitch Pd between the protrusions 5*a* are described to be equal. However, as shown in FIG. 13, the pitch Pc between the collecting electrodes 4 may be smaller than the pitch Pd between the protrusions 5*a*. In this case, the collecting electrodes 4 and the protrusions 5*a* are preferably aligned such that line of electric force are distributed as equally as possible to the collecting electrodes 4.

In this embodiment, the collecting electrode 4 in the form of a circular pipe has been described. However, the cross section of the collecting electrode 4 may have, other than the circular shape, an oval shape, an elliptical shape, a polygonal shape, or the like. The collecting electrode 4 may be solid rather than hollow like the pipe.

REFERENCE SIGNS LIST

1 electrostatic precipitator
4 collecting electrode
5 discharge electrode
5*a* protrusion (discharge portion)
7 flat electrode
α opening ratio
d equivalent diameter

The invention claimed is:

1. An electrostatic precipitator comprising:

a plurality of collecting electrodes having a cylindrical shape and arranged at intervals in a direction orthogonal to a longitudinal direction of the collecting electrodes; and a plurality of discharge electrodes arranged in parallel with the orthogonal direction and having a plurality of discharge portions protruding toward the collecting electrodes, wherein a direction of a gas flow is in parallel to the orthogonal direction or a direction of a gas flow is in parallel to the longitudinal direction, wherein an equivalent diameter of a cross section of a shape of the collecting electrodes is 30 mm to 80 mm, the equivalent diameter referring to a diameter of a circle having the same area as the cross section of the shape of the collecting electrodes, and wherein an opening ratio (a) of the collecting electrodes arranged at intervals is 10% to 70%, the opening ratio (a) being defined by the following expression:

$$\alpha=\{1-((d\times 3.14/2)/Pc)\}\times 100$$

where d is the equivalent diameter, and Pc is the center-to-center pitch between the collecting electrodes.

2. The electrostatic precipitator according to claim 1, wherein one and another of the discharge electrodes are arranged on opposite sides of the collecting electrodes arranged in the orthogonal direction corresponding to the discharge portions of the one of the discharge electrodes and the discharge portions of the other of the discharge electrodes at the same height protrude in the same direction, the one and the other of the discharge electrodes being arranged such that ionic wind flowing from the discharge portions of the discharge electrodes toward the collecting electrodes does not oppose ionic wind flowing from the discharge portions of the other discharge electrodes toward the collecting electrodes.

* * * * *